United States Patent [19]

Recchelbacher

[11] Patent Number: 4,934,855

[45] Date of Patent: Jun. 19, 1990

[54] SPRAY BRUSH FOR SIMULTANEOUS USE WITH A HAND-HELD HAIR DRYER

[75] Inventor: Horst M. Recchelbacher, Minneapolis, Minn.

[73] Assignee: A-Veda Corporation, Minneapolis, Minn.

[21] Appl. No.: 293,176

[22] Filed: Jan. 3, 1989

[51] Int. Cl.[5] ..... A46B 11/02

[52] U.S. Cl. ..... 401/137; 15/159 R; 132/148; 401/286; D4/136; D4/114

[58] Field of Search ..... 132/120, 148, 118; 401/137, 138, 139, 146, 149, 150, 289, 287, 286; D4/114, 116, 130–139; 15/201, 159 R, 160; 119/83, 85; 34/97

[56] References Cited

U.S. PATENT DOCUMENTS

| | | | |
|---|---|---|---|
| D. 127,983 | 7/1941 | Wechsler | D4/134 |
| D. 249,909 | 10/1978 | Epstein | D4/136 |
| D 290,910 | 7/1987 | Steadman | D4/136 |
| 2,103,493 | 12/1937 | Robertson | 401/279 |
| 2,828,500 | 4/1958 | Peacock | 401/137 |
| 3,253,292 | 5/1966 | Herschensohn | 132/156 |
| 3,516,424 | 6/1970 | Eagle | 401/137 |
| 4,030,158 | 6/1977 | Blair | 15/159 A |
| 4,254,738 | 3/1981 | Stanley | 119/83 |
| 4,277,193 | 7/1981 | Knauss | 401/183 |
| 4,423,531 | 1/1984 | Wall | 15/160 |

FOREIGN PATENT DOCUMENTS

| | | | |
|---|---|---|---|
| 1151795 | 8/1957 | France | 401/139 |

*Primary Examiner*—Richard J. Johnson

*Attorney, Agent, or Firm*—Peterson, Wicks, Nemer & Kamrath

[57] ABSTRACT

A spray brush includes a brush head having a relatively flat panel formed with a number of openings extending therethrough. Additionally, the brush head has a number of laterally projecting fingers forming notches therebetween. The tubular handle of the brush serves as a reservoir for a supply of hair styling composition. Through the agency of a manually actuated pump mechanism, liquid is pumped from the reservoir through a nozzle reciprocally disposed in a longitudinal slot formed in the panel. Thus, the spray brush, when held in one of the stylist's hands, can be used simultaneously with a hair dryer, when held in the stylist's other hand, so that the hair styling composition can be directed onto a person's head while air from the dryer is directed through the openings and notches at the same time.

13 Claims, 2 Drawing Sheets

SPRAY BRUSH FOR SIMULTANEOUS USE WITH A HAND-HELD HAIR DRYER

BACKGROUND OF THE INVENTION

1. Field of the Invention

This invention relates generally to hair brushes, and pertains more specifically to a spray brush containing a hair styling composition in the handle thereof and which brush is especially suited for use in combination with a hand-held hair dryer.

2. Description of the Prior Art

Hair brushes with a liquid-dispensing capability are not entirely new. For instance, there is U.S. Pat. No. 2,103,493 granted on Dec. 28, 1937 to Charles P. Robertson for "Dispensing Device." While this patented brush permits a liquid to be sprayed during the brushing procedure, it lacks the capability of being used effectively and efficiently with a hand-held hair dryer in that its brush head lacks any openings or notches through which warm air may be directed onto a person's head. Also, the patented dispensing device does not permit ready viewing of the hair areas where the liquid is being applied.

Whereas the above-identified patent makes use of a manually actuated plunger-type pump, U.S. Pat. No. 4,277,193 issued on July 7, 1981 to Ray Knaus for "Hair Grooming Device" utilizes a squeezable reservoir so the hair treating liquid can be forced through a plurality of small dispensing holes. Here again, the difficulty in this instance is that the device, not having openings in its head, is not designed to permit a hair dryer to be used in combination therewith. Also, the manner in which the liquid and quantity thereof is dispensed is not accurately controllable.

Hence, a need continues to exist for a satisfactory spray brush that can be used simultaneously with a conventional hand-held hair dryer.

SUMMARY OF THE INVENTION

An important object of my invention is to provide a spray brush structured so that a liquid hair styling composition may be dispensed therefrom during the styling procedure, and at the same time permitting the stylist to direct drying air to the region where the composition has been applied. More specifically, an aim of my invention is to provide a spray brush that can be held in one hand and by means of a plunger-type pump have the hair styling composition that is contained in the handle of the brush be accurately and precisely directed to various locations on the person's head. It is intended that the cosmotologist hold the brush in one hand and a conventional hair dryer in the other hand. My brush has a number of openings and notches extending through the head thereof so that the air from the dryer can be directed to the same regions where the hair styling composition is being applied. The openings and notches in the head of my brush also facilitates the accurate viewing of where the composition is being applied.

Briefly, my invention contemplates a hair brush having a hollow handle in which a suitable hair styling composition is contained. By reason of a manually operated plunger-type pump, the hair styling composition is applied through a reciprocably disposed nozzle mounted on the brush head which enables the composition to be precisely directed onto the person's head where needed, doing so through a number of openings and notches provided in the brush head. A hand-held dryer can be maneuvered so as to direct heated air to the very location where the styling composition is being applied. In other words, my spray brush is intended for simultaneous use with a hand-held hair dryer so that the stylist can rapidly create even intricately designed hairstyles and coiffures.

DESCRIPTION OF THE PREFERRED EMBODIMENT

Figure 2:
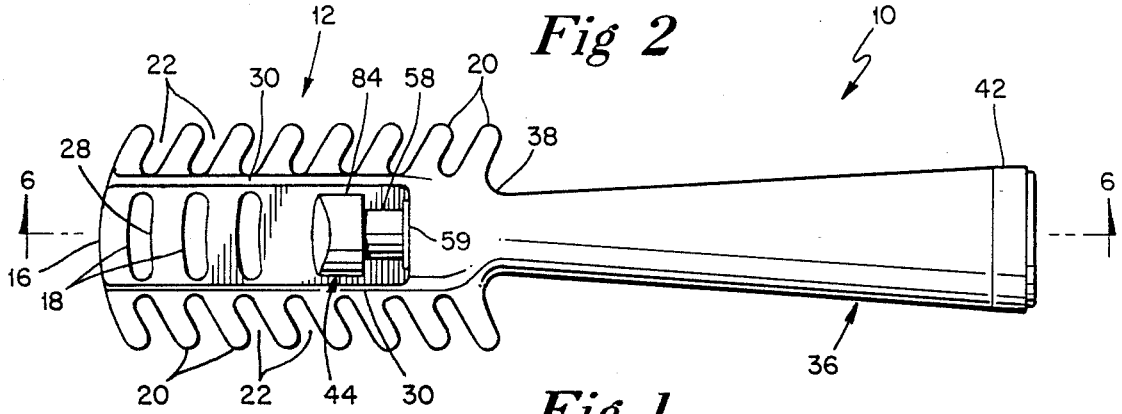
FIG. 2 is a top plan view thereof.
Figure 1:
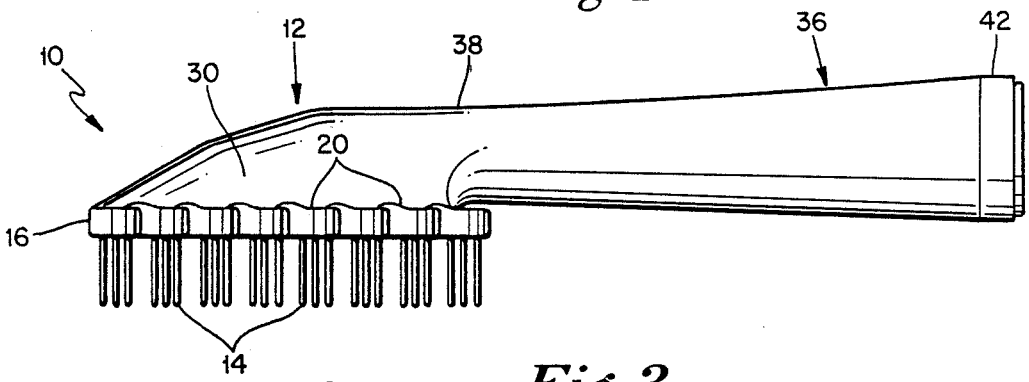
FIG. 1 is a side elevational view of my spray brush.

The spray brush exemplifying my invention is intended to be fabricated from a suitable plastic and has been indicated generally by the reference numeral 10. The brush 10 includes a brush head 12 having a multiplicity of bristles 14 that project downwardly from the underside of a panel 16.

The panel 16 is formed with three arcuate or slightly curved openings 18 extending therethrough. A greater number of openings 18 may be used, the number depending largely upon the size of the panel 16. The panel 16 is additionally formed with a relatively large number of laterally extending fingers 20 forming notches 22 therebetween.

Figure 3:
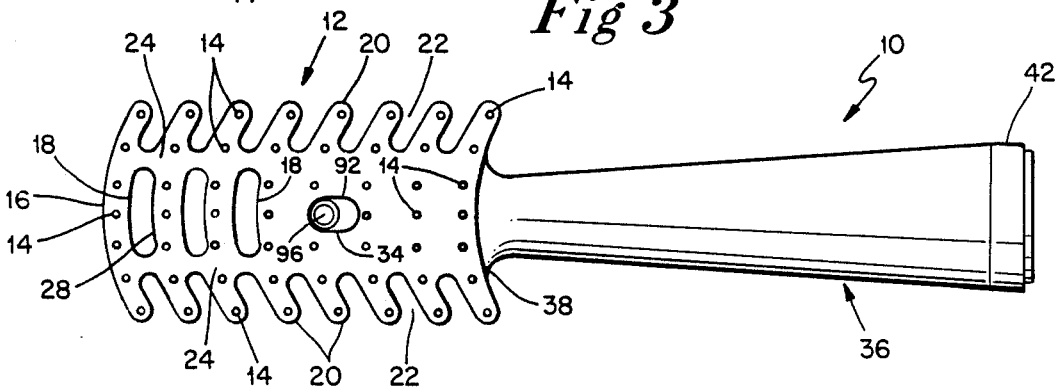
FIG. 3 is a bottom plan view.
Figure 4:
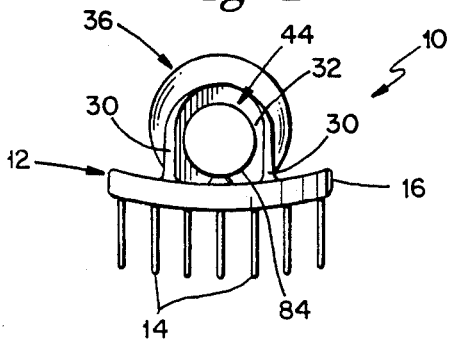
FIG. 4 is an end view taken from the left in FIG. 1.
Figure 5:
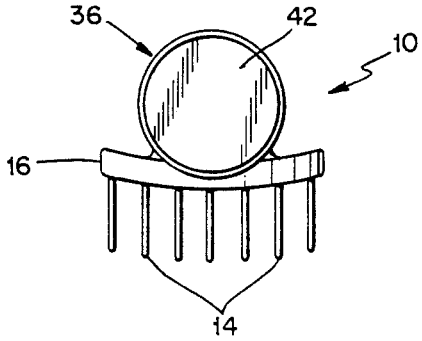
FIG. 5 is an end view taken from the right in FIG. 1.

From FIG. 3, it will be discerned that a pair of what will be termed longitudinal strip portions 24 result by reason of the way the openings 18 and notches 22 are oriented with respect to each other. In other words, one longitudinal strip portion 24 resides between the openings 22 and the notches 22 at one side, and the other strip portion 24 resides between the openings 18 and the notches 22 at the other side. Additionally, it can be stated that there are several transverse strip portions bordering the openings 18, these strip portions having been labeled 28. From FIG. 3, it will be noted that some of the bristles 14 are anchored to the various fingers 20, as well as to the region of the panel 16 residing between the longitudinal strip portions 24.

At this time, attention is directed to a pair of laterally spaced parallel ribs 30 forming a channel 32 therebetween. A relatively short longitudinal slot 34, as best viewed in FIG. 3, is provided in the panel 16, being located in the channel 32 formed by the flanking ribs 30. The purpose of the slot 32 will presently be explained. The brush head 12 is joined to a tubular or hollow handle 36 by an integral neck portion 38. The tubular handle 36 provides a reservoir 40 for containing therein a supply of a suitable hair styling composition. The free end of the handle 36 has a closure cap 42 threadedly attached thereto. The cap 42 can be readily removed in order to replenish the hair styling composition. It is not believed necessary to show the liquid hair styling composition.

Figure 7:
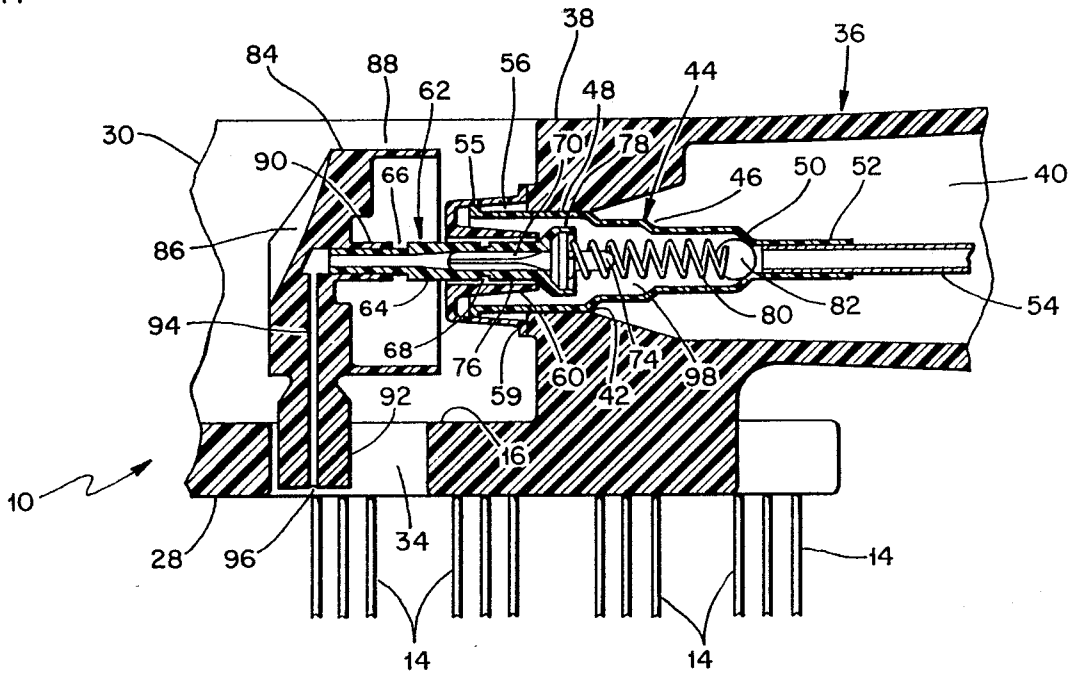
FIG. 7 is a greatly enlarged fragmentary sectional view taken in the same plane as is FIG. 6, but with the pump mechanism also in section.

The neck portion 38 intermediate the brush head 12 and the handle 36 has an opening or bore 42 therein which mounts a plunger-type pump mechanism 44. The pump mechanism 44 includes a barrel or housing 46 having a stepped cross section, as can be seen in FIG. 7. The larger cross section portion which has been identified by the reference numeral 48 is press fitted into the opening 42 in the neck portion 38. The smaller end of the barrel or housing 46 has an annular seat portion 50 which will be referred to in greater detail shortly. At this time, though, it will be observed that there is a tubular portion 52 extending to the right from the end where the annular seat portion 50 is located. The extension portion 52 receives therein one end of a dip tube 54.

The larger end of the barrel or housing 46 has a peripherally flanged end 55 that is received in an annular groove 56 formed in a collar member 58 having an out-turned flange 59 that bears against one surface of the neck portion 38. The collar 58 has a re-entrant or tubular portion 60 which reciprocably journals part of a pump piston 62. Actually, the piston 62 has a cylindrical portion 64 with a tubular portion 66 extending therefrom. There is a shank portion 68 projecting in the opposite direction from the tubular portion 66 that has a plurality of shallow longitudinal grooves 70 angularly disposed thereon. Also, the piston 62 includes an integral annular flange 72 and a spring-centering pin 74 projecting therefrom.

A sleeve 76 encircles the shank portion 68, the sleeve 76 having an enlarged or cup-shaped end 78 that encircles the flange 72. In this way, one end of a coil spring 80 abuts against the flange 72, the pin 74 extending or projecting into this end of the coil spring 80. The coil spring 80 normally biases a ball 82 against the seat portion 50 of the barrel or housing that has been previously mentioned, the ball 82 serving as a check valve.

The pump mechanism 44 further comprises a pushbutton head 84 having a forefinger-accommodating recess 86 and a cylindrical skirt 88. There is also a tubular portion 90 integral with the pushbutton head 84 that receives therein the tubular portion belonging to the piston 62. The tubular portion 66 on the piston 62 is press-fitted into the tubular portion 90 on the head 84.

The pushbutton head 84 has a downwardly extending nozzle 92 having a passage 94, the lower end of the passage 94 terminating in a discharge orifice 96.

It is believed that a sufficient amount of description has been given so as to provide an understanding of the manner in which my spray brush 10 is intended to function. What should be appreciated is that the barrel or housing 46 forms a chamber 98 that is sufficient to retain some of the hair styling composition contained in the reservoir 40 provided by the handle 36.

Figure 6:
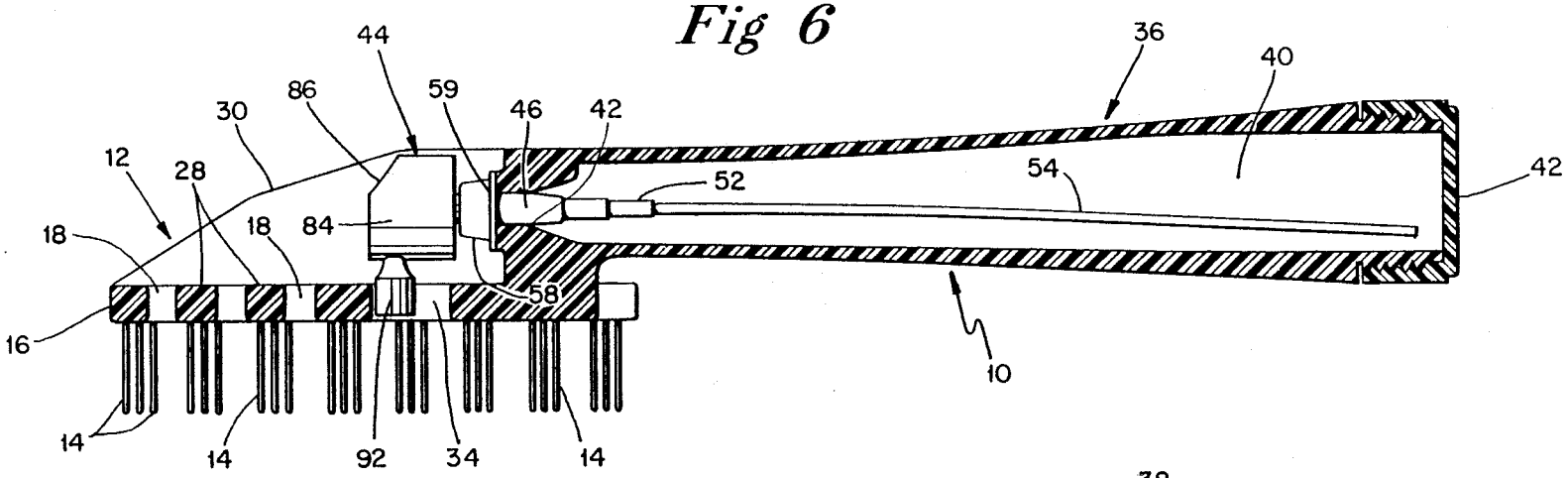
FIG. 6 is a slightly enlarged sectional view taken in the direction of line 6—6 of FIG. 2, but with the pump mechanism shown unsectioned.

As an illustration, it can be appreciated that when my spray brush 10 is held vertical, that is rotated through 90° from the position in which it appears in FIG. 6 so that the cap 42 is lowermost, there is no problem whatsoever with respect to the composition entering the open end of the dip tube 54. Hence, there is no difficulty in actuating the pushbutton head 84 so that the piston 62 acts against the coil spring 80 which forces the ball 82 against the seat portion 50 so that whatever hair styling liquid previously pumped into the chamber 98 of the barrel is retained therein. In other words, the ball 82 prevents a reverse flow of the liquid composition back into the reservoir 40. However, when the operator allows the pushbutton head 84 to move upwardly because the coil spring 80 is under these conditions allowed to expand and thus relieve the pressural action of the spring 80 against the ball 82, some of the liquid hair styling composition is drawn or sucked into the chamber 98 where it remains until the pushbutton head 84 is manually actuated to force the ball 82 against the seat portion 50. The only route that the liquid can travel due to the piston 62 advancing toward the ball 82 is out through the orifice 96, doing so via the grooves 70 and the tubular portion 66 leading to the passage 94.

With a reasonably filled reservoir 40, there is no problem with respect to pumping the hair styling composition onto a person's head. However, when the supply of composition has been virtually depleted, it can be appreciated that the spray brush 10 when rotated through, say, 90° with the cap 42 uppermost, there will be no liquid entering the free end of the dip tube 54. However, by simply tilting or rotating the spray brush 10 so that it is momentarily in a position with the cap 42 lowermost and actuating the pushbutton head 84 to first force the piston 62 downwardly, followed by a removal of finger pressure on the head 84, then a supply of hair styling composition will be drawn into the chamber 98. This is attributable to the fact that on each pumping stroke a small charge of liquid composition is drawn into the chamber 98 of the barrel 46. On the next pumping stroke, that charge is forced outwardly through the nozzle 92 onto a person's head irrespective of the brush's orientation. To resupply the chamber 98 each time when only a small quantity of composition remains in the reservoir 40, the spray brush 10 must again be oriented vertically with the cap 42 lowermost so that the dip tube 54 extends into whatever liquid composition remains. Of course, when there is a sufficient amount of liquid in the reservoir 40, an amount such that the free or entrance end of the tube 54 depends into the composition, the hairstylist need not be concerned with the orientation of the brush 10.

While the precise construction of the plunger-type pump 62 is not critical, it is very important that the spray brush 10 should be functional in virtually any position in which it is held. My spray brush 10 accomplishes this important aim.

Having presented the foregoing description, the benefits to be derived from a practicing of my invention should be appreciated. What should be distinctly noted and taken into account is that the spray brush 10 is held in one hand and that only one finger of that one hand is needed to press repeatedly the pushbutton head 84 to the right as viewed in the various figures with the consequence that the nozzle 92 moves to the right in the slot 34 of the panel 16 constituting part of the brush head 12. Each time the manual pressure is removed, the coil spring 80 immediately returns the nozzle 92 to the left, that is, the position in which it appears in the drawings. Thus, repeated actuation of the pump mechanism 44 by way of the pushbutton head 84 will produce successive discharges of the hair styling composition onto the person's head. Both the amount and direction of the sprayed composition are precisely controlled, the amount by reason of the stroke or distance through which the pushbutton head is moved and the direction by virtue of the position in which the brush 10 is held.

The laterally spaced ribs 30 forming the channel 32 in which the pushbutton head 84 resides provide a finger-guiding function in addition to reinforcing the panel 16. Thus, the hairstylist may very well wish at times to lay down the brush 10. When picking up the brush 10 again by the tubular handle 36, the stylist, while grasping the handle 36, can readily place his or her forefinger against the recess 86 of the head 84 in preparation for actuating the head 84 to effect a pumping and spraying operation.

While my spray brush 10 is being held and maneuvered in one hand, the cosmotologist's other hand is available for holding a conventional hair dryer. The various openings 18 and notches 22 provide ready viewing of where the nozzle 92 is directing the hair styling composition. Of greater importance is the ability of the stylist to dry simultaneously the locations where the hair styling composition is being applied, the openings 18 and notches 22 enabling this to be done efficiently and effectively.

It is very important to recognize that a complete stying of hair, including modern-day intricate and fluffed-up coiffures, can be easily achieved when using my spray brush 10 in conjunction with a conventional hand-held hair dryer. Once again, it should be fully understood that the spray brush 10 is held in one hand and the hair dryer in the other hand. Inasmuch as the hair dryer that is contemplated for use when using my invention is conventional, no need is seen to depict such a hair dryer. Professional hairstylists, who have experienced the inconvenience throughout the years of being faced with the problem of not being able to simultaneously and conveniently brush a person's hair, apply a liquid styling composition and immediately dry the applied composition, will appreciate the ease with which these three steps can be concurrently realized when practicing my invention.

I claim:

1. A spray brush comprising a brush head having a plurality of openings extending therethrough and notches therein via which air from a hand-held hair dryer may be directed onto a person's head, a tubular handle integral with said brush head, and means for pumping a liquid hair styling composition contained in said tubular handle through said brush head onto a person's head at the same time air is being directed onto the same person's head via said openings and notches.

2. A spray brush in accordance with claim 1 including a plurality of spaced fingers extending along each side of said brush head, said fingers forming said notches.

3. A spray brush in accordance with claim 2 in which said openings extend transversely across said brush head.

4. A spray brush in accordance with claim 3 in which said brush head includes a pair of laterally spaced longitudinal ribs, said openings extending transversely between said ribs.

5. A spray brush in accordance with claim 4 in which said brush head has a longitudinal slot therein, and said pumping means includes a nozzle reciprocably disposed in said longitudinal slot.

6. A spray brush in accordance with claim 5 in which said pumping means includes a pushbutton head integral with said nozzle, said pushbutton head residing between said laterally spaced ribs.

7. A spray brush comprising a panel having a longitudinally directed slot near one end thereof and a plurality of openings via which air from a hand-held hair dryer may be directed onto a person's head, a multiplicity of bristles projecting from one face of said panel, a tubular handle projecting from said one end of said panel, a plunger-type pump mechanism including a nozzle reciprocable in said slot, a pushbutton head integral with said nozzle, and means associated with said pushbutton head for delivering a hair styling composition from said tubular handle to said nozzle when said pushbutton head is manually actuated, whereby some of the hair styling composition contained in said handle can be sprayed through said nozzle onto a person's head at the same time air is being directed through said openings from a hand-held hair dryer.

8. A spray brush in accordance with claim 7 in which said panel includes a plurality of fingers extending laterally from each side thereof to form notches therebetween via which air from a hand-held hair dryer may be additionally directed onto a person's head.

9. A spray brush comprising a brush head having a plurality of openings extending therethrough and a longitudinal slot therein, said slot being nearer one end of said brush head, a multiplicity of bristles projecting from one side of said head, a tubular handle projecting from said one end of the head for containing a supply of liquid hair styling composition therein, and a plunger-type pump mechanism including a spray nozzle disposed for a reciprocable movement in said slot, a pushbutton head adjacent the opposite side of said brush head and integral with said nozzle, and means for directing some of said liquid composition from said tubular handle to said nozzle when said pushbutton head is manually actuated, whereby air from a hand-held hair dryer can be directed onto a person's head through said openings while simultaneously actuating said pushbutton head.

10. A spray brush in accordance with claim 9 in which said openings are centrally disposed in said panel, said panel having laterally extending fingers providing notches therebetween so that additional air may be directed through said notches onto a person's head.

11. A spray brush in accordance with claim 10 in which some of said bristles project from said fingers.

12. A spray brush in accordance with claim 10 in which said openings are in the form of transverse slots.

13. A spray brush in accordance with claim 12 including a pair of laterally spaced ribs on said opposite side of said head facing oppositely from the direction in which said bristles project, said pushbutton head residing in the channel formed by said ribs.

* * * * *